United States Patent [19]

Gilbertson

[11] Patent Number: 4,492,536

[45] Date of Patent: Jan. 8, 1985

[54] HYDRAULIC OIL WELL PUMPING UNIT

[76] Inventor: Thomas A. Gilbertson, 216 Sandringham, N., Moraga, Calif. 94556

[21] Appl. No.: 513,948

[22] Filed: Jul. 15, 1983

Related U.S. Application Data

[63] Continuation of Ser. No. 271,592, Jun. 8, 1981, abandoned.

[51] Int. Cl.[3] ..... F04B 47/08

[52] U.S. Cl. ..... 417/401

[58] Field of Search ..... 417/390, 398, 399, 401, 417/403, 563, 569, 570; 166/187

[56] References Cited

U.S. PATENT DOCUMENTS

| | | | |
|---|---|---|---|
| 346,206 | 7/1886 | Jensen | 417/559 |
| 1,488,842 | 4/1924 | Squires . | |
| 1,599,601 | 9/1926 | Watts . | |
| 1,864,609 | 6/1932 | Musolf . | |
| 1,946,723 | 2/1934 | Thompson | 417/378 |
| 2,005,995 | 6/1935 | Knox . | |
| 2,132,084 | 10/1938 | Reiss . | |
| 2,229,635 | 1/1941 | Boynton | 166/187 X |
| 2,286,926 | 6/1942 | Parenti . | |
| 2,299,315 | 10/1942 | Evans | 417/559 X |
| 2,703,585 | 3/1955 | Coberly | 137/625.6 |
| 2,748,712 | 6/1956 | Sargent . | |
| 2,812,721 | 11/1957 | Coberly | 417/563 |
| 2,837,029 | 6/1958 | Mohnkern . | |
| 2,952,212 | 9/1960 | Coberly . | |
| 3,015,280 | 1/1962 | King | 417/401 |
| 3,123,007 | 3/1964 | Orr | 417/390 X |
| 3,133,594 | 5/1964 | Condra | 166/187 X |
| 3,437,142 | 4/1969 | Conover | 166/187 X |
| 3,540,814 | 11/1970 | Roeder . | |

*Primary Examiner*—Leonard E. Smith

*Attorney, Agent, or Firm*—Flehr, Hohbach, Test, Albritton & Herbert

[57] ABSTRACT

An oil well pumping unit comprising an oil pump unit and a hydraulic cylinder coupled in driving relation to the pump unit and adapted to be mounted along with the pump unit within a bore hole. The cylinder has top and bottom fluid ports and a cylinder rod operatively driving the pump unit. Hydraulic drive/control means is coupled to one of the fluid ports to provide a hydraulic power stroke of said cylinder rod in one direction. The other of the fluid ports of said cylinder is coupled to the well fluid column above said cylinder or to a closed energy storage system to provide energy for producing a return stroke of the cylinder rod. The oil pump unit includes: an elongated cylindrical pump barrel with a first stationary valve mounted at a bottom end of the pump barrel for controlling the entry of bore hole fluid and a second stationary valve mounted at a top end for controlling the exit of oil from the pump barrel into the well casing above said pumping unit.

A packing means is mounted in an intermediate position on the pump barrel for retaining the pump barrel in a position within the well casing and forming a seal between the inner wall of the well casing and the pump barrel to define high and low pressure regions of the well respectively above and below the packing means.

A cylinder mounting means is provided for mounting said hydraulic cylinder in a substantially sealed manner on top of the pump barrel with the cylinder rod coaxial with the pump barrel and sized to be received within the pump barrel on a downstroke of the cylinder rod to displace bore hole fluid within the pump barrel through the second valve.

14 Claims, 10 Drawing Figures

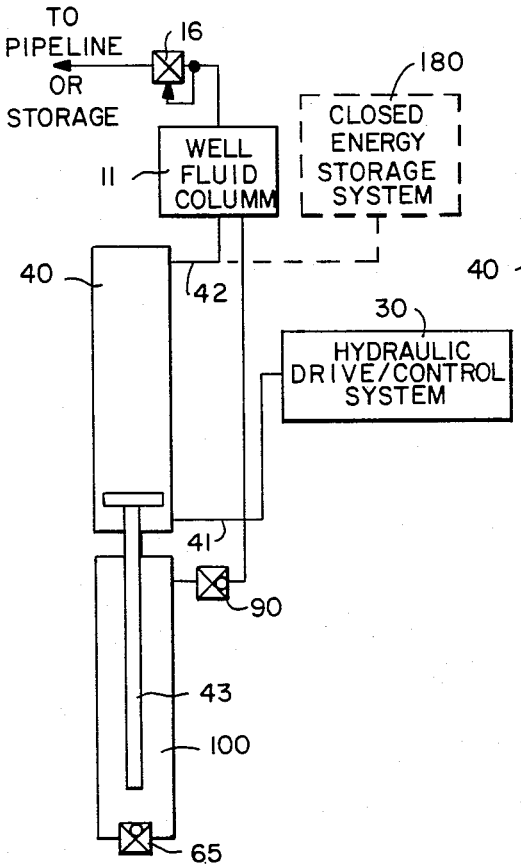
FIG.—5
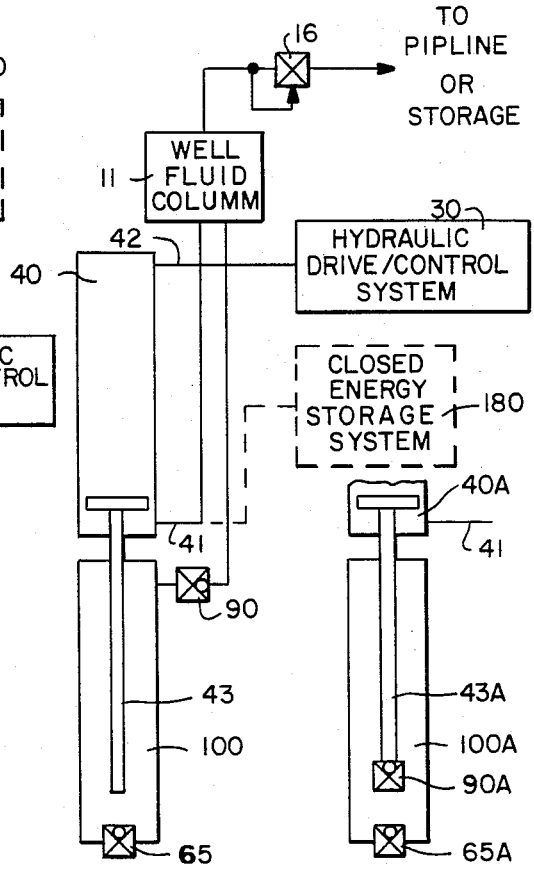
FIG.—6
FIG.—7
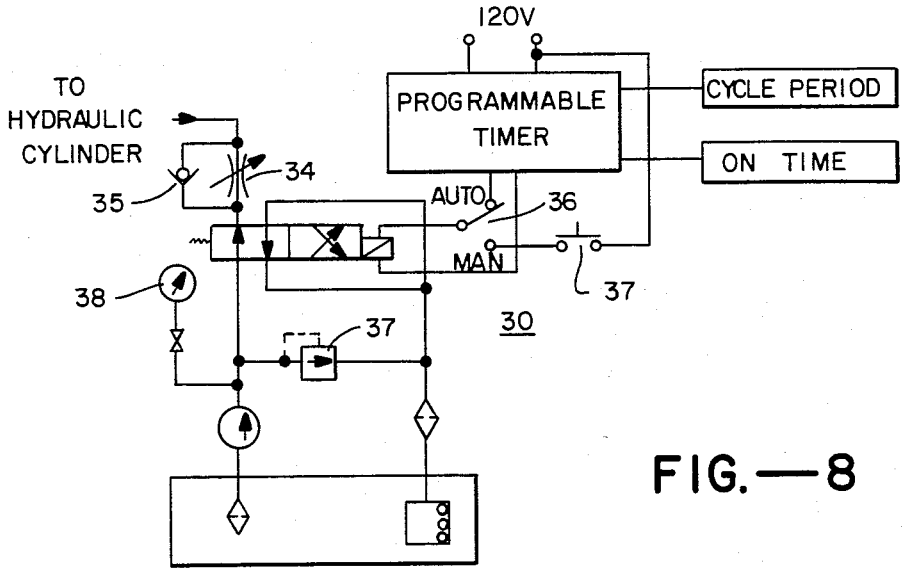
FIG.—8

HYDRAULIC OIL WELL PUMPING UNIT

This is a continuation of application Ser. No. 271,592, filed June 8, 1981, now abandoned.

This invention relates generally to oil well pumping units and specifically to oil well pumping units utilizing a hydraulic cylinder to produce a relatively slow pumping stroke. More specifically, this invention relates to an oil well pumping unit which utilizes a hydraulic cylinder and a pump unit adapted to be mounted at or near the oil producing zone in the bore hole.

One of the conventional styles of oil well pump driving units is the walking beam, horsehead unit in which the walking beam and horsehead are driven in a rocking motion. A cable arrangement running over the horsehead is utilized to raise and lower a polished rod which extends through a stuffing box arrangement mounted above the pumping tee on the wellhead casing. The other end of the polished rod is connected to a sucker rod string which extends down hole and is mounted on the other end to one of the conventional types of reciprocating pumps. The reciprocating pump is mounted in a tubing string which extends down the bore hole concentric with the well casing.

This conventional type of pump driving unit comes in various sizes to produce various pump stroke lengths depending on the capacity of the well. For smaller wells, units with a stroke length between about twelve and twenty inches per stroke are used. For larger wells, pumping units with a stroke between forty and one hundred seventy inches per stroke may be used. Typically, these horsehead pumping units are run at fairly high stroke rates of anywhere from about eight to twelve strokes per minute on the smaller units to twelve to thirty strokes per minute on the larger units. The rapid reciprocating motion of the rod string produces certain undesirable operating effects. From a mechanical standpoint this rapid reciprocation produces acceleration, shock, and harmonic loading of the rod string with accompanying high peak rod loads, all of which shorten the life of the rod string. Moreover, the rapid pumping stroke of this type of pump driving unit reduces the volumetric pump efficiency due to the rate at which the pump is attempting to move oil up the tubing string and because of the agitation and pounding of the fluid in the well. The actual pump stroke is substantially less than the stroke of the driving unit due to the stretching of the rod string under the load of the column of fluid in the bore hole and the weight of the rod string itself.

An additional problem that can be encountered in pumping wells containing light oil (i.e. oil which has a substantial volume of dissolved gas), is gas lock of the pump. Gas lock is generally caused by the gas released from the oil in the formation at a rapid rate as the pressure drops in the pump on the upstroke. If the pressure on the head of liquid in the bore hole is not sufficient to compress the gas released into the pump chamber on the upstroke, pressure of the expanded volume of gas at the top of the pump barrel will not exert sufficient pressure on the traveling valve to counteract the pressure of the fluid column on that valve. Consequently, the valve will not open and no fluid will be moved by the pump. Under this condition the plunger in the pump merely compresses and expands the gas in the pump barrel. This gas lock problem can make it extremely difficult to pump down some very gaseous wells.

A number of the problems involved in the rapid reciprocating stroke of the horsehead-type pump unit can be eliminated by utilizing a long slow-moving pump stroke produced by a hydraulic cylinder to drive the reciprocating pump through a rod string. Mason U.S. Pat. No. 1,708,584 and Palm U.S. Pat. No. 1,845,176 disclose oil well pump driving units utilizing a hydraulic cylinder mounted over the pumping tee and stuffing box arrangement at the wellhead. Heath U.S. Pat. No. 2,949,861 also discloses a hydraulic cylinder type of pumping rig. In addition the following copending Gilbertson patent applications disclose oil well pump driving units in which a hydraulic cylinder mounted at the surface of the bore hole is utilized to drive a submerged reciprocating pump unit through the typical rod string arrangement:

(1) Application Ser. No. 148,380 entitled "OIL WELL PUMP DRIVING UNIT", filed May 9, 1980;

(2) Application Ser. No. 183,958, entitled "OIL WELL PUMP DRIVING UNIT", filed Sept. 3, 1980;

(3) Application Ser. No. 237,366, entitled "OIL WELL PUMP DRIVING UNIT", filed Feb. 23, 1981.

While the above-referenced Gilbertson patent applications disclose improved cylinder mounting arrangements and simplified hydraulic drive/control systems which greatly improve the surface driven type of hydraulic pump driving unit, they rely on the conventional rod string traversing a tubing string extending from the surface to the bottom of the bore hole. The cost of the tubing string and the rod string add substantially to the finishing cost of a well and, in addition, the weight of the rod string increases the hydraulic pumping force required for driving the reciprocating pump at the bottom of the bore hole.

Oil well pumping units in which the hydraulic pump driving unit and the driven reciprocating fluid pump section are both positioned at the bottom of the bore hole are also known in the art. Most of these down hole hydraulic pump units utilize a continuous supply of operating fluid to the pump driving cylinder together with an internal valving arrangement which directs the operating fluid to appropriate locations within the pump to provide both a hydraulic power upstroke and downstroke. In some of the prior art arrangements, the spent operating fluid is exhausted from the pump driving section into the tubing carrying the production fluid. In others the operating fluid is recirculated through separate supply and exhaust channels from the pump driving cylinder. Generally these prior art systems involve a relatively complicated hydraulic fluid piping system for the pump unit. Those which require a continuous supply of operating fluid either utilize the well production fluid which tends to contaminate the hydraulic pumping unit or otherwise utilize an expensive reservoir of hydraulic fluid. Generally these prior art units pump the well fluid through a tubing string. Thus the only cost saving involved is the elimination of the rod string, at least a portion of which is reduced by the cost of providing piping arrangements to the hydraulic cylinder down the bore hole.

Accordingly, it is a principal object of this invention to provide an improved oil well pump unit which utilizes a hydraulic cylinder and a pump assembly adapted to be mounted at or near the oil producing zone in a bore hole.

It is a further object of this invention to provide an oil well pumping unit adapted to be mounted directly within the well casing of a bore hole.

It is another object of this invention to provide an improved, simplified, and less expensive oil well pump unit for pumping relatively shallow, small-capacity wells.

One aspect of this invention features an oil well pumping unit comprising an oil pump unit and a hydraulic cylinder coupled in driving relation to the pump unit and adapted to be mounted along with the pump unit at the bottom or other oil producing zone of a bore hole. The hydraulic cylinder has top and bottom fluid ports and a cylinder rod operatively driving the pump unit. A hydraulic drive/control means is coupled to one of the fluid ports to provide a hydraulic power stroke of said cylinder rod in one direction. Means are provided for coupling the other of the fluid ports in the cylinder to the well fluid column above the cylinder or to a closed energy storage system to provide energy for producing a return stroke of the cylinder rod.

Preferably the oil pump unit comprises an elongated cylindrical pump barrel with a first stationary valve mounted at a bottom end of the barrel for controlling the entry of bore hole fluid and a second stationary valve mounted at the top of the pump barrel for controlling the exit of oil therefrom into the well casing above the pumping unit. A packing means is mounted in an intermediate position on the pump barrel for retaining the pump barrel in position within the well casing and for forming a seal between the inner wall of the well casing and the pump barrel. This defines high and low pressure regions of the well respectively above and below the packing means. Cylinder mounting means are provided for mounting the hydraulic cylinder in a substantially sealed manner on top of the pump barrel with the cylinder rod coaxial with the pump barrel and sized to be received within the pump barrel on a downstroke to displace bore hole fluid within the pump barrel through the second valve. The packing means preferably comprises an inflatable cylindrical bladder together with means mounting opposite ends of the bladder to the pump barrel in a concentric relationship therewith and a valve means for communicating an inflating fluid to the bladder to force an outer cylindrical surface of a central portion thereof into high pressure contact with the well casing.

In a preferred enbodiment the packing means includes a packer mounting collar mounted in a sealed relation to the exterior of the pump barrel a moderate distance below the top end thereof. A check valve assembly is mounted to the packer mounting collar by way of a check valve mounting collar which defines a first annular fluid channel between an inner surface of the check valve collar and an outer surface of the pump barrel. A check valve is mounted to the check valve collar with the check valve mounting collar including an inflating fluid passage formed between the check valve and the first annular fluid channel. An inflatable bladder assembly is coupled to the check valve assembly and includes a bladder support cylinder mounted to the check valve mounting collar and forming a second annular fluid channel between an interior surface of the bladder support cylinder and the outer surface of the pump barrel. An inflatable cylindrical bladder is mounted on opposite ends to the exterior of the bladder support cylinder. A combined sealing and pressure release valve assembly is mounted to the bottom of the bladder support cylinder and includes a pressure release valve communicating with the second annular fluid channel and having a preset pressure release threshold. The bladder support cylinder has a plurality of apertures formed through the walls thereof to communicate inflating fluid to the bladder, and the check valve is coupled to the power hydraulic fluid line leading to the hydraulic cylinder for initial inflation of the bladder to a pressure below the threshold of the pressure release valve. This retains the pump unit in a position within the well casing. The check valve subsequently communicates inflation fluid to the pressure release valve above the threshold thereof to blow the pressure release valve and deflate the bladder to permit removal of the pumping unit from the well casing.

The sealing and pressure release valve assembly preferably comprises a pressure valve collar mounted on the bottom of the bladder support cylinder and defining an annular fluid channel between the pressure valve collar and the exterior of the pump barrel. A valve channel is formed between top and bottom surfaces of the pressure valve collar and an aperture is formed between the valve channel and the annular fluid channel. A sealing means is mounted on the bottom of the pressure valve collar for providing a fluid-tight seal at the bottom end of the annular fluid channel. A blowout pressure valve is mounted in the valve channel and comprises a valve stem received within the valve channel and a sealing ring carried on each end of the valve stem to provide a fluid seal between the valve stem and the valve channel. The valve stem has a central section of reduced cross-section forming a tension release pin having a preset separation pressure threshold at which the tension pin will separate and be blown out of the valve channel.

In a preferred embodiment the cylinder mounting means and the second stationary valve form a combination valve and cylinder mounting assembly. This assembly includes a cylinder mounting collar mounted to the top of the pump barrel and having a passageway extending therethrough receiving the cylinder rod in a sliding seal arrangement. A check valve assembly is provided in the cylinder mounting collar adjacent the cylinder rod passageway. A lower fluid passageway extends between the check valve in a region below the cylinder rod passageway and an upper fluid passageway extends between the check valve and an external surface of the mounting collar. Preferably this combined valve and cylinder mount assembly further includes a valve bypass channel extending between the upper fluid passageway and the cylinder rod passageway. The cylinder rod preferably has at least one flat edge surface formed at the bottom end thereof adapted to communicate with the valve bypass channel when the cylinder rod is at the end of its upstroke.

In a preferred embodiment of the oil well pump unit the hydraulic drive/control means is coupled to the bottom fluid port and the coupling means coupled to the top fluid port comprises a hydraulic fluid storage tube coupled on one end to the top fluid port and open on the other end to the well fluid column. The storage tube has an internal volume at least as great as the internal fluid volume of the hydraulic cylinder and a volume of hydraulic fluid is contained within the storage tube. At least one traveling piston is carried within the storage tube to provide a traveling seal at the fluid interface between the hydraulic fluid therein and the well fluid. In a preferred embodiment of an oil well pump unit in accordance with this invention the unit includes components which essentially can be assembled together with complementary threaded surfaces so that the unit can be readily assembled during initial manufacture and there-after easily disassembled for repair or replacement of any portions thereof.

One of the principal advantages of this invention is that it provides a simple submergeable pump and pump driving unit which may be mounted directly within the casing of an oil well without requiring any sucker rod string or tubing string to be placed within the bore hole. Once the well has been drilled and is ready to produce, the pump unit of this invention can simply be lowered into the bore hole and the packing means operated to secure the pump unit at the proper location at or near the bottom of the bore hole. A closed hydraulic fluid system is utilized to drive the pump in one direction and the energy stored in either a closed energy storage system or the energy stored in the fluid column itself is utilized to provide the return stroke of the pump unit.

The pump unit has the advantage of simplicity of construction and thus provides a very attractive low-cost unit especially for relatively shallow, small-capacity oil wells. The inflatable packing arrangement provided by the invention together with the pressure release valve system facilitates both additional installation of the pump unit and a later withdrawal of the pump unit from the bore hole for any maintenance or service required thereon.

The integral bypass valve arrangement provided in a preferred embodiment assures that the pump barrel will be filled with fluid on the downstroke thereof. This totally eliminates any possiblity of gas lock of the pump since any volume of gas above the fluid in the barrel will be replaced by well fluid from above the check valve.

A combination of the oil well pump unit of this invention and the simple hydraulic drive/control system disclosed in the above-identified copending Gilbertson application Ser. No. 183,958, provides a simple, inexpensive, and reliable oil well pumping system and greatly reduces the complexity and cost of producing oil from small and medium capacity wells.

Other objects, features, and advantages of this invention will be apparent from a consideration of the following detailed description taken in conjunction with the accompanying drawings.

FIG. 1 is a partly schematic elevational view of an oil well pumping unit in accordance with this invention.

FIGS. 2A–2C together form a cross-sectional view of a preferred embodiment of the major components of an oil well pumping unit in accordance with this invention.

FIGS. 5–7 are schematic views of alternative embodiments of an oil well pumping system in accordance with this invention.

FIG. 8 is a schematic view of a preferred hydraulic drive/control system useful in connection with this invention.

Figure 1:
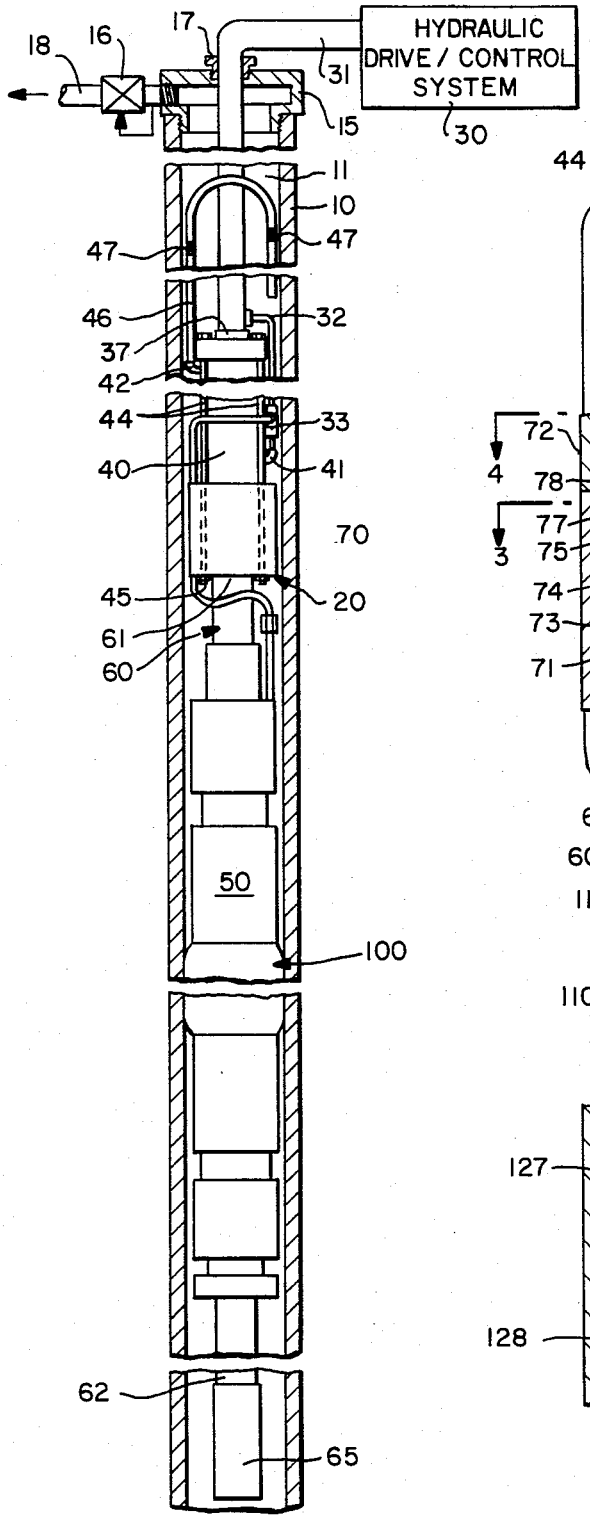
FIG. 1 illustrates one embodiment of an oil well pump unit 20 in accordance with this invention mounted within an oil well casing 10.

The pumping unit 20 is mounted at the bottom of the casing 10 at a location where the casing 10 contains a pool of oil from the surrounding formation through which the bore hole has been drilled. The pumping unit 20 is designed for a particular size of casing 10 and the size of the pumping unit 20 (i.e. the length of the pump barrel 60 and the corresponding length of the hydraulic cylinder 40) are designed in accordance with the anticipated production capacity of the well. For purposes of illustration, the pumping unit 20 to be described herein is one designed to be mounted within a well casing 10 having an internal diameter of about four inches. The pump barrel 60 is a $1\frac{1}{4}$ inch pipe, ten feet long, and a ten foot hydraulic cylinder 40 is mounted to the pump barrel 60. This unit is especially designed for relatively low-producing wells up to about 20 barrels a day utilizing a two stroke per minute pump rate. The pumping unit is especially useful in low-producing wells which are relatively shallow, i.e. where the pumping unit is installed at a depth of around 500 feet. It should, of course, be appreciated that the pumping unit of this invention may be manufactured in a variety of sizes to mount within various sizes of well casing and further can be adapted to various pump barrel sizes, pump stroke lengths and pump stroke rates so that the invention may be utilized in a wide variety of oil well pumping situations involving varying well sizes, depths, and production volumes.

Referring specifically to the oil well pumping unit installation depicted in FIG. 1, it is seen that the casing 10 has a pumping tee 15 directly mounted thereto at the top of the bore hole. The well casing 10 is shown as broken just below the pumping tee 15, illustrating that the top of the pumping unit 20 is separated by a long distance from the top of the casing 10. At various other points the oil well pump unit 20 is broken for convenience of illustration. In the usual prior art approach, the well is finished with a gas tee mounted to the casing and with a tubing hanger mounted to the gas tee to suspend a tubing string down the bore hole concentric with the casing. As previously indicated this tubing string is not required with the pumping unit of this invention. In the prior art system the pumping tee is mounted to the top of the tubing string and a rod string extends through the tubing string to drive the submerged reciprocating pump from a pump driving unit mounted at the surface. In this case no separate gas tee is required, but of course the usual gas tee and separate pumping tee approach may be employed with this invention if desired. In the outlet pipe 18 from the pumping tee 15, a pressure relief valve 16 may be employed for purposes which will be later explained.

Hydraulic fluid from a hydraulic drive/control system 30 is communicated to the hydraulic cylinder 40 of the pump unit 20 through a single hydraulic fluid tube 31 which extends through a sealing gland 17 at the top of the pumping tee 15. This hydraulic fluid tubing 31 may be utilized to lower the pumping unit 20 down the bore hole during the initial installation process. Alternatively, the pumping unit 20 may be lowered down the bore hole utilizing a cable with the tubing 31 merely serving to communicate hydraulic fluid to the hydraulic cylinder 40. Where the tubing 31 is utilized to lower the pumping unit 20 down the bore hole, it is preferably a seamless tubing which is attached to the top of the hydraulic cylinder 40 by means of any suitable bracket 37. The bracket 37 would mount the tubing 31 to the top of the cylinder at a center point so that the tubing would be coaxial with the pumping unit. Of course, if a cable were utilized the cable would be attached to a center bracket at the top of the cylinder 40 and the hydraulic fluid line 31 would be mounted to a bracket at another convenient point on the top of cylinder 40.

The main elements of oil well pumping unit 20 are hydraulic drive/control system 30, hydraulic cylinder 40, and pump unit 50 driven by the hydraulic cylinder 40. The main components of pump unit 50 are a pump barrel 60, check valve assembly 65, cylinder mounting collar assembly 70, and packer assembly 100. The check valve assembly 65 is mounted on the bottom end 62 of the pump barrel 60. The cylinder mounting collar assembly 70 is mounted on the top end 61 of pump barrel 60. Packer assembly 100 is mounted concentric to pump barrel 60 at an intermediate location between the top end 61 and the bottom end 62 thereof. The details of these main assemblies of the pump unit 50 will be discussed below in conjunction with FIGS. 2–4.

As shown in FIG. 1 the main hydraulic tubing 31 extending down the bore hole communicates hydraulic fluid from hydraulic drive/control system 30 to the hydraulic cylinder 40. A small diameter hydraulic fluid line 32 is coupled to the main fluid line 31 and communicates hydraulic fluid through a T-coupling 33 into the bottom input port 41 of hydraulic cylinder 40. As will be described later, the other output of the T-coupling 33 goes to a check valve associated with the packer assembly 100. The top fluid port 42 of hydraulic cylinder 40 is connected to a hydraulic fluid storage tube 46 which extends into the bore hole above the cylinder 40 and has an open end 46A in communication with the well fluid in the bore hole. One or more traveling pistons 47 are carried within the hydraulic fluid storage tube 46 to preclude mixing and contamination of the hydraulic fluid within storage tube 46 with the well fluid in the well column above the pump unit 20. The purpose of this arrangement will be discussed later in connection with a description of the overall operation of the pumping unit in conjunction with FIG. 5. As shown in FIG. 1 hydraulic cylinder 40 mounts to the cylinder mounting collar assembly 70 utilizing extended mounting rods 44 and mounting bolts 45 fastened at the lower end of the cylinder mounting collar assembly 70 and at the upper end of the top flange of hydraulic cylinder 40.

Figure 2A:
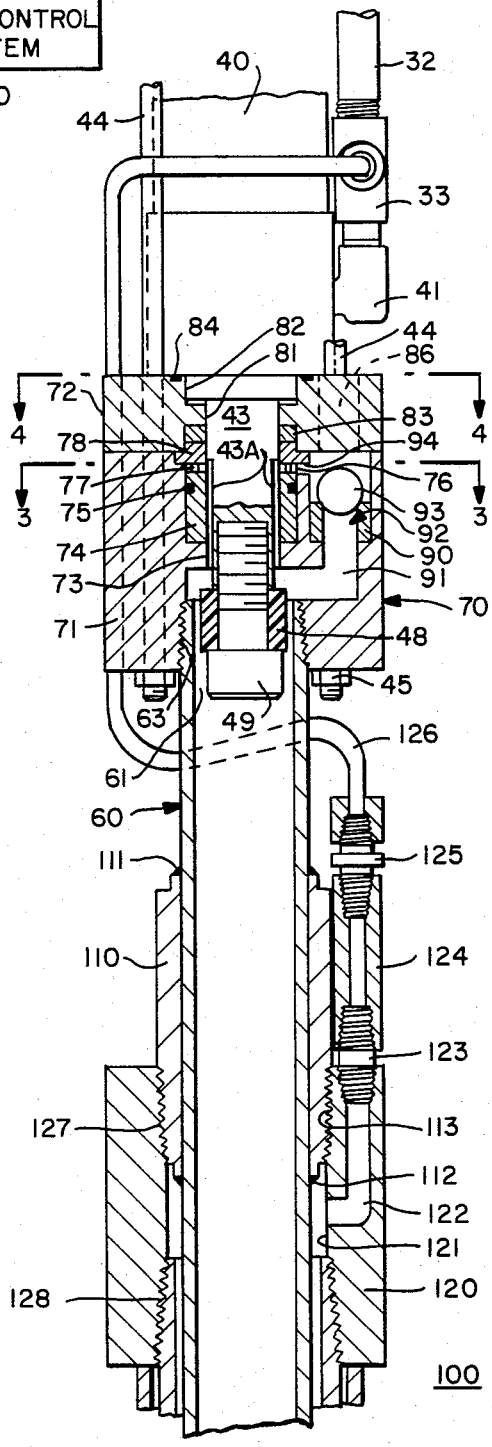
Figure 2B:
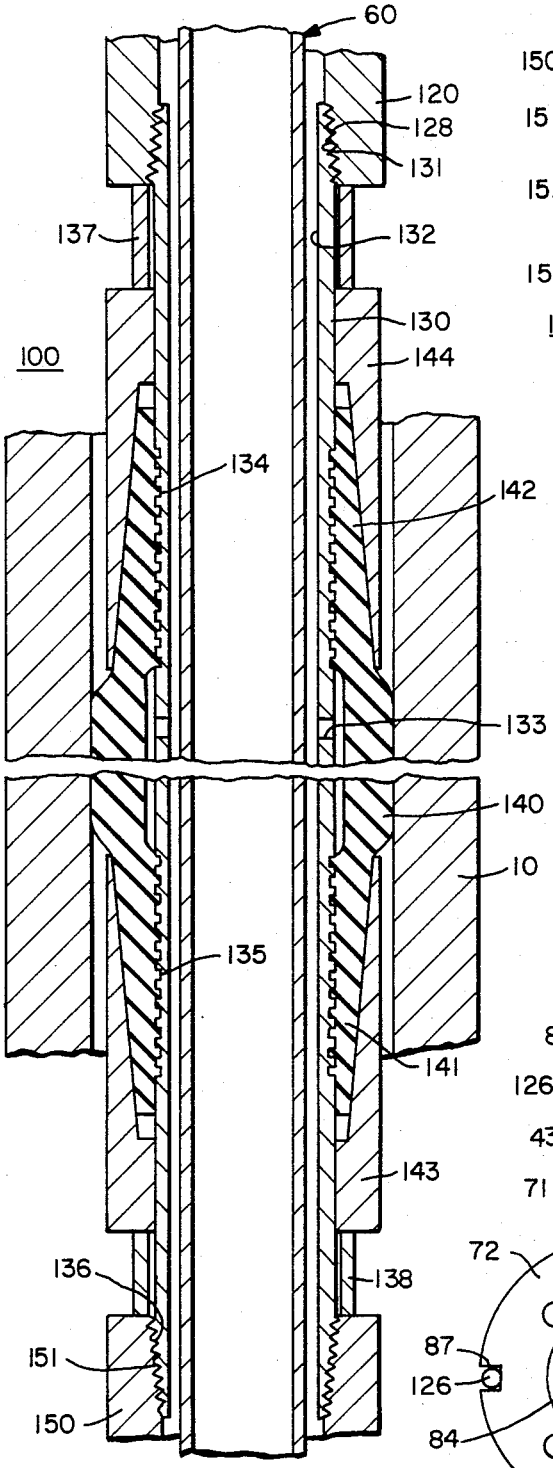
Figure 2C:
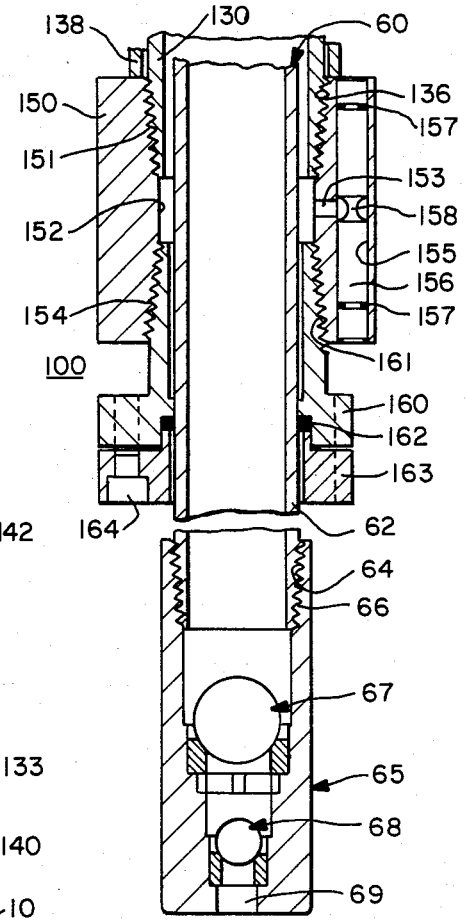
Figure 3:
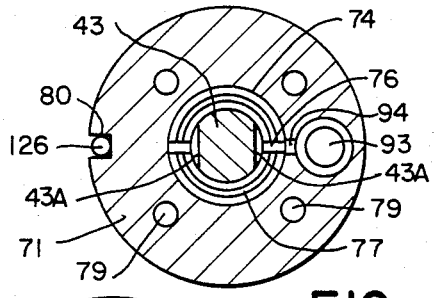
FIG. 3 is a section view of one component of an oil well pump unit in accordance with this invention taken along the lines 3—3 in FIG. 2A.
Figure 4:
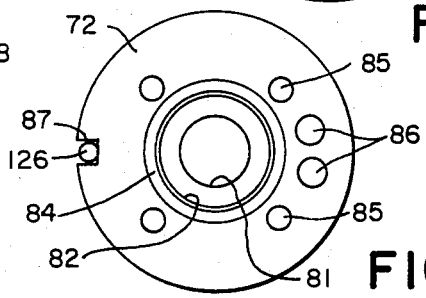
FIG. 4 is a top view of one component of an oil well pumping unit in accordance with this invention taken along the lines of 4—4 in FIG. 2A.

Referring now to FIGS. 2 through 4, the structural and operational details of the pump unit 50 and its mounting to hydraulic cylinder 40 will be described. Referring together to FIGS. 2A, 2B, and 2C, it is seen that the pump barrel 60 comprises a cylindrical pipe section which has a set of tapered threads 63 formed on the exterior surface of the top end 61 thereof and a set of tapered external threads 64 formed on the bottom end 62 thereof (FIG. 2C). For a pump unit to be mounted within a four inch well casing, a 1¼ inch pipe section may conveniently be used. For purposes of this discussion a pipe section about ten feet long will be assumed. At the bottom end 62 of the ten foot pipe section, a stationary check valve assembly 65 is mounted as shown in FIG. 2C. Check valve assembly 65 is shown incorporating two tandem check valve assemblies 67 and 68. Check valve assembly 65 is mounted to the bottom end 62 of the pipe section 60 utilizing a set of tapered internal threads 66 to thread it onto the corresponding set of tapered threads 64 on the pipe section. An inlet aperture 69 admits well fluid from the formation into the check valve assembly 65.

Referring now to FIG. 2A the cylinder mounting collar assembly 70 is shown threaded onto the set of tapered screw threads 63 at the top end 61 of the pipe section 60. The cylinder mounting collar assembly 70 includes a bottom mounting collar 71 and a top mounting collar 72 which are bolted together along with the hydraulic cylinder 40 utilizing the extended cylinder mounting rods 44 and the bolts 45. As shown in FIGS. 3 and 4 each of the separate mounting collars 71 and 72 have four mounting rod apertures therein. The mounting rod apertures 85 in collar 72 are in registration with the mounting apertures 79 in the collar 71.

A central channel 73 extending through the mounting collar 71 and a central channel 81 extending through the mounting collar 72 are sized to admit the cylinder rod 43 into the interior of the pipe section 60. The bottom end of cylinder rod 43 has a plastic washer 48 fastened thereto with a bolt 49. The washer 48 has an outer diameter slightly larger than that of cylinder rod 43 and thus provides a bearing surface which will contact the inner wall of the pump barrel pipe section 60 on the downstroke of the cylinder rod if there is any slight bow in the pipe section.

Adjacent the central channel 73 in the collar 71 a cylindrical region is machined out to place a bushing 74 therein which provides a sliding seal with the outer surface of the cylinder rod 43. An O-ring seal 75 is provided on the exterior surface of the bushing 74 to prevent fluid leakage around the outside surface thereof. A check valve assembly 90 is located in one wall of the mounting collar 71 between a fluid entry channel 91 in mounting collar 71 and a pair of separate fluid exit channels 86 in mounting collar 72. The check valve assembly 90 includes a valve seat 92 and a spherical valve element 93 forming a check valve structure which permits fluid to flow through the valve only in the exit direction from the pipe section 60.

However, in the exit chamber of the check valve assembly 90 an aperture 94 is formed which cooperates with radial slots 76 and a circumferential slot 77 to serve as a valve bypass channel into the cylinder rod channel 73. Cylinder rod 43 has two flat surfaces 43A formed thereon at the bottom of the rod, thereby forming two fluid channels into the interior of the pump barrel 60 when the cylinder rod 43 is at the end of its upstroke. At this point the well fluid above the check valve 90 enters the slots 76 and 77 and traverses the fluid channels beside the flats 43A on the cylinder rod to completely fill the interior of the pump chamber. The function of this will be described in more detail later.

A second bushing 78 is provided at the top of the mounting collar 71 to assist in registering the second mounting collar 72 thereon. A third bushing 83 is mounted within the collar 72 to form an additional sliding seal bearing surface for the cylinder rod 43. The nose of cylinder 40 is received within the recess 82 formed in mounting collar 72. An O-ring 84 mounted in the top surface of the mounting collar 72 provides a seal against well fluid entering the pump chamber around the outside surface of the cylinder rod 43. The bushings 74, 78, and 83 serve to wipe the external surface of the cylinder rod 43 and thereby prevent substantial amounts of contaminating well fluid from being carried by the cylinder rod 43 into the interior of the cylinder 40. Slotted channels 80 and 87 are formed on one side of the mounting collars 71 and 72 to receive the hydraulic fluid tube 126 which brings hydraulic fluid from the coupling tee 33 to the check valve assembly below the mounting collars.

As shown in FIGS. 2A, 2B, and 2C, the packer assembly 100 includes the following principal components: a packer mounting collar 110, a check valve collar 120, a bladder support pipe 130, an inflatable bladder 140, a pressure release valve assembly 150, and a sealing means 160 which seals the bottom of the packer assembly against the exterior surface of the pump barrel pipe section 60. Packer mounting collar 110 is mounted to the exterior surface of the pump barrel 60 a moderate distance below the cylinder mounting collar assembly 70. The packer mounting collar 110 may be mounted in a sealed fashion to the pump barrel 60 utilizing weldments 111 and 112 at the top and bottom cylindrical end regions thereof. The bottom circumferential weldment 112 must be carefully done not only to attach the packer mounting collar 110 to the pump barrel 160 but also to provide a fluid-tight seal against any fluid leakage between the exterior wall of the pump barrel and the interior wall of the packer mounting collar. A set of tapered threads 113 are formed on the bottom end of the packer mounting collar for fastening the check valve collar 120 thereto utilizing the internal thread set 127 thereon.

Check valve collar 120 defines an inner channel wall 121 which forms, with the exterior wall of the pump barrel 60, a first fluid channel. Hydraulic fluid is admitted into the first fluid channel 121 through an entrance port 122 which communicates with a check valve 123 mounted to the top surface of the check valve collar 120. An extension 124 and a coupler 125 connect the check valve 123 to the hydraulic fluid line 126 which brings hydraulic fluid from the coupling tee 33. The check valve 123 is oriented to admit hydraulic fluid into the first fluid channel 121 and to prevent any subsequent escape of the fluid from the interior of the packer assembly. A set of tapered interior threads 128 is provided at the bottom of check valve collar 120 for mounting a bladder support pipe 130 thereto utilizing complementary tapered threads 131 formed thereon.

Bladder support pipe 130 has a central channel 132 with an inner diameter slightly greater than the outer diameter of the pump barrel 60 to form a second fluid channel running the length of the bladder support pipe and communicating with the first fluid channel 121 of the check valve collar 120. Accordingly hydraulic fluid communicated through the check valve 123 will enter the first fluid channel 121 and the second fluid channel 132 of the bladder support pipe 130. A plurality of apertures 133 are formed in a central region of the bladder support pipe 130 to communicate the fluid from the second fluid channel 132 to the exterior of the bladder support pipe on which is carried the inflatable bladder 140. The mounting of the inflatable bladder 140 to the bladder support pipe 130 will be described below. On the bottom end of the bladder support pipe 130, a set of tapered threads 136 is formed for mounting the pressure release valve assembly 150 thereto utilizing a complementary set of tapered threads 151.

The pressure release valve assembly 150 comprises a cylindrical collar having a central channel having interior walls 152 of a diameter slightly larger than the outer diameter of the pump barrel to form a continuation of the second fluid channel. A cylindrical valve channel 155 is formed in one wall section of the pressure release valve collar 150 and extends between the top and bottom surfaces thereof. A port 153 is formed between the central channel wall 152 and the valve channel 155. A valve stem 156 is mounted within the valve channel 155 and includes a pair of sealing rings 157 positioned on each end thereof to provide a fluid seal between the valve stem and the valve channel. A tension release pin 158 is formed on a central region of the valve stem 156. Tension pin 158 consists of a necked down section of the valve stem 156 and has a predetermined breaking point related to fluid pressure within the annular fluid channel 152 communicated through the port 153. When this pressure threshold is exceeded, the tension pin 158 separates and blows the two halves of the valve stem 156 apart releasing the fluid pressure from within the interior of the packer assembly 100. The function of this pressure release valve will be discussed below. It should be understood that other pressure release valve structures could also be employed to perform this function.

On the bottom of the central channel 152 of the pressure release valve 150 a set of tapered threads 154 are formed for mounting a sealing collar assembly 160 utilizing complementary tapered threads 161. An O-ring 162 is provided on the interior surface of the sealing collar 160 and maintained in position by a separate collar segment 163 which is fastened to the sealing collar 160 by a set of screws 164. The O-ring 162 seals the bottom of the annular fluid channel on the bottom end of the packer assembly 100.

Referring back to FIG. 2B the top and bottom end sections 141 and 142 of the inflatable bladder 140 are vulcanized on to slotted groove section 134 and 135 of the bladder support pipe 130. In addition the wedge collars 143 and 144 cooperate with the tapered end sections 141 and 142 of the inflatable bladder 140 to compress the end sections onto the bladder support pipe. As the bladder support pipe 130 is threaded into the check valve collar 120 the spacer collar 137 forces the wedged internal surface of the tapered collar 144 over the tapered outer surface of the top end 142 of the cylindrical bladder 140, thereby compressing the end wall section 142 onto the bladder support pipe. This is performed at the same time that the pressure release valve assembly is threaded onto the other end of the bladder support pipe so that the spacer collar 138 pushes the other wedged retaining collar 143 over the bottom tapered end portion 141 of the inflatable bladder 140. The central section of the inflatable bladder 140, involving a length of about twelve inches, is free to expand against the inner wall of the casing 10 as shown in FIG. 2B. This happens when fluid is pumped through the check valve 123 (FIG. 2A) into the annular fluid channel within the bladder support pipe and through the fluid ports 133.

From the above description of the pump unit 50, it will be readily appreciated that the various components thereof are easily assembled together during the initial manufacturing operation and can also readily be disassembled for any service or replacement of parts thereof. To install the pump unit together with the cylinder 40 in an oil well, the overall pumping unit is dropped down the bore hole utilizing either the main hydraulic fluid supply tube 31 or a separate cable as previously explained. The overall pumping unit is lowered until it reaches the appropriate position at the bottom of the bore hole and then hydraulic fluid is supplied through the supply tube 31 to a pressure of about 3000 pounds per square inch. This hydraulic fluid pressure is communicated through the T-coupling 33 and the check valve 123 into the packer assembly 100 where it inflates the bladder 140 into a high pressure contact with the inner wall of the casing. The inside wall of the casing 10 is typically a roughened surface which cooperates with the high pressure force of the outer wall of the bladder 140 to retain the pump unit at that position within the well. The hydraulic pressure is then released, but the pressure within the packer assembly is maintained due to the action of the check valve 123.

Later when it is desired to release and remove the pump unit from the bore hole, high pressure hydraulic fluid is again supplied through the check valve 123 to pressurize the packer assembly 100 to a valve above the threshold tension force of the shear pin 158. This causes the tension pin 156 to separate, blowing at least the bottom half thereof out of the bottom end of the valve channel 155 past the slot 165 in the sealing assembly 160. This releases the fluid pressure from inside the packer assembly, collapsing the bladder and permitting the pumping unit to be withdrawn from the casing 10. When the packer assembly 100 is initially inflated, the valve stem 156 is retained within the valve channel due to the symmetry of the tension pin and the substantially equal pressures on the top and bottom surfaces of the valve stem.

Prior to installing pump unit 20 within the casing 10, the top portion of the cylinder 40 is filled with hydraulic fluid which, on intitial pressurization to operate the packer assembly 100 forces the hydraulic fluid into the fluid storage tube 46. After the pump unit is installed and the packer assembly is pressurized to retain the pump unit in position, the pumping action of the unit can then be commenced. To initiate the pumping action, the region of the bore hole above the pumping unit is filled with a priming fluid which may either be water or oil, and, if necessary, the well fluid above the unit is pressurized to force a downstroke of the cylinder rod. The initial volume of priming fluid will enter the pump barrel (if it is not already filled with well fluid from the formation) through the bypass valve channel in the cylinder mounting collar assembly 70. On the downstroke of the cylinder rod, the fluid in the pump barrel 60 is displaced by the cylinder rod. The check valves 67 and 68 remain closed at the bottom of the pump barrel and the check valve 90 opens to transfer the displaced fluid from the pump barrel into the region of the bore hole above the packer assembly 100. At the same time, as the cylinder rod is traversing its downstroke, the hydraulic fluid within the fluid storage tube 46 gradually enters the top of the cylinder above the piston therein and a commensurate volume of the well fluid replaces the hydraulic fluid in the storage tube 46. This increases the fluid storage volume on the high pressure side above the packer assembly so the fluid displaced from the pump chamber is simply transferred on the downstroke to an enlarged well volume above the packer assembly.

After the cylinder rod has reached the end of its downstroke, hydraulic drive/control system 30 supplies hydraulic fluid to the bottom port 41 to initiate a power upstroke of the cylinder rod 43. On this power upstroke, the withdrawing cylinder rod 43 lowers the pressure in the pump barrel and opens the check valves 67 and 68 to draw well fluid into the pump barrel. Simultaneously, the hydraulic fluid above the piston in hydraulic cylinder 40 is being pushed back into the fluid storage tube 46, displacing the well fluid therein and reducing the well fluid capacity above the pumping unit. This forces an amount of well fluid equal to the volume previously displaced from the pump barrel up the well column and out the pumping tee 15.

A pressure relief valve 16 may be provided at the pumping tee outlet to maintain the pressure within the well fluid column at a certain minimum pressure in order to insure that, at the end of the hydraulic power upstroke, sufficient energy will be stored in the well fluid column to cause a return downstroke of the cylinder rod via the difference in static pressure applied above and below the piston within the cylinder 40. To insure sufficient differential head of pressure, a certain level of water, for example ten or twenty feet thereof may be maintained within the well column above the pumping unit. This assists in causing the cylinder rod downstroke due to the difference in density between the water and other well fluids and the lighter hydraulic fluid in the supply pipe 31 and underneath the piston within the cylinder 40.

It will thus be appreciated that on each downstroke of the cylinder rod 43, the displaced fluid from the pump barrel will be communicated through the check valve assembly 90 to the well fluid column above the packer assembly and partially make up the loss of fluid from the well column entering the fluid storage tube 46 as the cylinder piston rod retracts. Then on each power upstroke, the first component of the fluid volume displaced from the upper portion of the cylinder into the hydraulic fluid storage tube 46 forces out an amount of fluid which makes up the difficiency in the well column volume, after which a volume of fluid equal to the volume displaced from the pump chamber is pushed out of the cylinder, causing a corresponding delivery of the same fluid volume out of the pumping tee 15 through the pressure relief valve 16.

It should also be appreciated that the provision of the bypass valve within the cylinder mounting collar assembly 70 totally eliminates any possibility of gas lock of the pump. At the top of the upstroke of the cylinder rod 43 any difficiency in well liquid volume within the pump chamber is made up, and any gas released thereinto is communicated into the fluid column above the pumping unit. This insures that the check valve assembly 90 will open on the downstroke of the cylinder rod rather than simply compressing gas within the pump barrel. While any fluid volume which passes through the bypass valve into the pump barrel at the end of the cylinder rod upstroke reduces the volumetric pumping capacity of the pumping unit, this is a preferred alternative to the risk of gas lock of the pump. Furthermore, to the extent that a volume of gas rather than well liquid is contained within the pump barrel, the oil pumping capacity is reduced in any event and actual production is increased by displacing the gas from the pump barrel so that the check valve assembly 90 will open sooner on the downstroke of the cylinder rod.

FIG. 5 illustrates schematically the pumping system and its function just described. FIG. 5 also illustrates that, instead of coupling the top fluid port of the hydraulic cylinder 40 to the well fluid column, either directly or through the hydraulic fluid storage tube 46 shown in FIG. 1, the top port 42 could alternatively be coupled to a closed energy storage system 180 which would store, within an enclosed fixed volume, a sufficient amount of energy on the power upstroke of the cylinder 40 to cause a return downstroke against the static head of the hydraulic fluid in the supply tube 31 and the pressure applied to the bottom of the cylinder rod 43. In this alternative pumping system arrangement, the delivery stroke of the pumping unit would be the downstroke of the cylinder rod. In other words, on the cylinder rod downstroke the fluid displaced from the pump barrel through the check valve assembly 90 would be forced out of the well fluid column through the pumping tee 15 since there would be no reduction in the fluid storage volume in the well fluid column above the pumping unit. The closed energy storage system 180 could take various forms such as, for example, a sealed tube containing a compressable gas which is compressed by a piston or bladder moving in response to the hydraulic fluid pushed out of the hydraulic cylinder chamber on the hydraulic power upstroke of the cylinder. Controlling the amount of energy stored in the closed energy storage system 180 together with controlling the setting of restricter valve 34 shown in FIG. 8 as a part of the preferred hydraulic drive/control system 30 produces a preset cylinder rod downstroke rate.

It is thus seen that the pumping unit generally depicted in FIG. 1 may be operated to have a fluid delivery stroke either as the hydraulic power upstroke of the cylinder or as the stored energy power downstroke of the cylinder depending on whether the top fluid port of the cylinder is coupled to the well fluid column or to a closed energy storage system.

FIG. 6 illustrates schematically an alternative way of driving the pumping system of this invention. In the FIG. 6 embodiment the top fluid port 42 of the hydraulic cylinder 40 is coupled to a hydraulic drive/control system 30 and the bottom fluid port 41 is alternatively coupled to the well fluid column 11 or to a closed energy storage system 180. In this version, however, the fluid delivery cycle of the pump is always the hydraulic powered downstroke. Consider first when the bottom fluid port 41 is coupled to the well fluid column 11. On the hydraulic powered downstroke, fluid below the piston in the cylinder is displaced into the well fluid column along with the fluid displaced from the pump barrel by the cylinder rod 43. On the upstroke, fluid from the well fluid column or hydraulic fluid stored in a storage tube enters the hydraulic cylinder reducing the fluid volume in the column by the amount of liquid intake into the cylinder. Then on the next downstroke, the reduced volume in the well fluid column is made up as fluid is pushed out of the region below the piston of the cylinder 40 together with some of the fluid displaced from the pump barrel and then a final volume of fluid equal to the fluid displaced in the pump barrel is pumped out of the well fluid column through the pressure relief valve 16.

If the bottom fluid port 41 is connected to a closed energy storage system 180, then the fluid volume within the well fluid column 11 does not change during the upstroke of the cylinder rod 43. However, on the downstroke of the cylinder rod 43, the fluid displaced from the pump barrel is pumped into the well fluid column and a corresponding volume of fluid is pumped out the pressure relief valve 16.

FIG. 7 illustrates that this same pump operating concept of this invention can be applied to a oil well pump unit in which the hydraulic cylinder is directly driving a conventional reciprocating pump arrangement utilizing a traveling valve 90A which pulls fluid out of the pump barrel on the upstroke of the cylinder rod 43A. However, in this case, the fluid delivery cycle of the pump is always on the upstroke of the cylinder rod 43A regardless of how the fluid entry ports of the hydraulic cylinder are coupled to the hydraulic drive/control system and to the well column or closed energy system as depicted alternatively in FIGS. 5 and 6. It should thus be understood that this aspect of the invention which provides an oil well pumping unit requiring only a single hydraulic fluid line running down the bore hole to the hydraulic cylinder may be utilized in conneciton with a conventional reciprocating pump design or with the novel pump design of FIGS. 2A–2C which forms another feature of this invention.

FIG. 8 depicts schematically a preferred version of a hydraulic drive/control system 30 which may be utilized in connection with this invention. The hydraulic drive/control system 30 is described in detail in the above-referenced Gilbertson application Ser. No. 183,958 and that description is hereby incorporated by reference into this disclosure. Generally, the hydraulic drive/control system 30 functions to drive the hydraulic cylinder 40 in this oil well pumping unit approach in the same fashion that it drives the hydraulic cylinder in the oil well pump driving unit described in the above-mentioned copending application. The hydraulic drive/control system 30 may also be utilized in connection with this invention to pressurize the packer assembly 100 both during initial installation and during the procedure to blow the pressure release valve for removal of the pump unit from the casing. By placing the hydraulic drive/control means 30 in the manual control mode by means of switch 36 and by setting the pressure release valve 37 to the maximum hydraulic pressure to be delivered to the packer assembly down the bore hole, the hydraulic drive system can provide the bladder inflating pressure by the operation of switch 37 until the pressure builds up to the desired valve as indicated on the guage 38. Thus, while the invention is not limited to any particular hydraulic drive/control system, the system 30 depicted in FIG. 8 is ideally suited to be married to the cylinder and pump unit of this invention to provide an overall oil well pumping system.

It should be apparent from the above description that this invention involes several features. First the invention involves a novel system for operating a down hole hydraulic cylinder for driving an oil pump unit which requires only one hydraulic fluid line to communicate fluid from the surface to the down hole hydraulic cylinder and requires no switching and valving arrangement in connection with the down hole cylinder. The invention also features a novel down hole pump unit which can be directly mounted within the well casing without requiring any tubing string or rod string and this pumping unit may be operated in accordance with the driving system of this invention or any more conventional down hole hydraulic drive system involving multiple hydraulic fluid lines running down the hole or having switching and valving arrangements down hole to generate the upstroke and downstroke of the cylinder rod. This invention further features the combination of the hydraulic down hole drive system and the novel pump unit to achieve a simple and inexpensive overall down hole pumping system which is easy to assemble, easy to install at the well site and easy to service and maintain after installation.

While the principles of this invention have been set forth above in connection with a preferred embodiment, it should be apparent that there are numerous modifications that could be made by persons of skill in the art without departing from the scope of this invention. For example, an embodiment of this invention could be provided without the valve bypass channel in the cylinder mounting collar assembly depicted in FIG. 2A and such a unit would operate satisfactorily on many wells which do not have a potential gas lock problem. In such an embodiment the check valve at the top of the pump barrel could be provided as a separate check valve arrangement communicating with a fluid channel entering the cylinder mounting collar instead of utilizing a check valve assembly built into the cylinder mounting collar itself. Instead of utilizing tapered threads to fasten the various components of the pump unit 50 together, other fastening arrangements such as welding could be utilized. However the thread-together approach is preferred since it enables the ready disassembly of the pump unit for any service or maintenance required on the components thereof. Various alternative approaches could be taken to fastening the inflatable bladder on the top and bottom ends thereof to the bladder support pipe. For example various single or multiple clamping rings independently tightened around the end regions of the inflatable bladder could be utilized. Numerous other fastening approaches would also suggest themselves to those of skill in this art and could readily be adapted to this pump unit. Accordingly, it should be understood that this invention is not limited to the preferred embodiment disclosed above and that numerous modifications could be made without departing from the scope of the invention as claimed in the following claims.

What is claimed is:

1. An oil well pump unit adapted to be mounted within an oil producing zone of an oil well bore hole and comprising a pump barrel in the form of an elongated section of pipe; an elongated pump rod adapted to be received within and to traverse said pump barrel; an integral pump rod seal and check valve assembly mounted on top of said pump barrel and including means for receiving said pump rod in a sliding seal engagement to permit said pump rod to enter said pump barrel; said pump rod seal and check valve assembly further including a valve bypass channel extending between a fluid passageway above said check valve and said pump barrel; said pump rod having at least one flat edge surface formed at a bottom end thereof and being adapted to communicate with said valve bypass channel when said pump rod is at the end of its upstroke so as to permit well fluid above said check valve to enter said pump barrel through said bypass and thereby to displace any gas within said pump barrel.

2. The apparatus of claim 1, wherein said pump rod seal and check valve assembly is adapted to mount a hydraulic cylinder in a sealed manner on top of said pump barrel, said hydraulic cylinder including a cylinder rod serving as said pump rod and sized to traverse of the interior of said pump barrel to displace fluid therefrom on a downstroke of said hydraulic cylinder.

3. An oil well pumping unit comprising an oil pump unit and a hydraulic cylinder coupled in driving relation to said pump unit and adapted to be mounted along with said pump unit within a bore hole; said cylinder having top and bottom fluid ports and a cylinder rod operatively driving said pump unit; hydraulic drive/control means coupled to one of said fluid ports to provide a hydraulic power stroke of said cylinder rod in one direction; and means coupling the other of said fluid ports of said cylinder to the well fluid column above said cylinder or to a closed energy storage system to provide energy for producing a return stroke of said cylinder rod; said hydraulic drive/control means being coupled to said bottom fluid port and said coupling means coupled to said top fluid port comprising a hydraulic fluid storage tube coupled on one end to said top fluid port and open at the other end to the well fluid column, said storage tube having an internal volume at least as great as the internal fluid volume of said hydraulic cylinder, a volume of hydraulic fluid being contained within said storage tube, and at least one traveling piston being carried within said storage tube to provide a traveling seal at the fluid interface between said hydraulic fluid and said well fluid.

4. The oil well pumping unit of claim 3, wherein said pump unit comprises a displacer pump including a pump barrel and cylinder mounting means for mounting said hydraulic cylinder in a substantially sealed manner on top of said pump barrel and including an integral stationary valve for controlling the exit of oil from said pump barrel into said well casing above said pumping unit, said cylinder mounting means and said stationary valve form a combination valve and cylinder mounting assembly comprising a cylinder mounting collar mounted to the top of said pump barrel and having a passageway extending therethrough receiving said cylinder rod in a sliding seal arrangement, a check valve assembly provided in said cylinder mounting collar adjacent said cylinder rod passageway, and a lower fluid passageway extending between said check valve and a region below said cylinder rod passageway, and an upper fluid passageway extending between said check valve and an external surface of said mounting collar.

5. An oil well pump unit as claimed in claim 4, wherein said combined valve and cylinder mount assembly further includes a valve bypass channel extending between said upper fluid passageway and said cylinder rod passageway and said cylinder rod has at least one flat edge surface formed at the bottom end thereof adapted to communicate with said valve bypass channel when said cylinder rod is at the end of its upstroke.

6. An oil well pumping unit adapted to be mounted within a well casing of a bore hole and to be driven by a hydraulic cylinder, said unit comprising:

an elongated cylindrical pump barrel formed of a cylindrical pipe section with outer diameter substantially less than the inner diameter of said well casing and having tapered threads formed on the exterior surface at each end thereof;

a check valve assembly threaded onto the bottom end of said pipe section;

a cylinder mounting collar assembly threaded onto the top end of said pipe section and adapted to mount said hydraulic cylinder in coaxial relationship with said cylindrical pipe section, said mounting collar assembly including a cylinder rod channel extending therethrough adapted to receive the cylinder rod of said hydraulic cylinder in a sliding sealed relation and to admit said cylinder rod into said cylindrical pipe section on a down stroke of said cylinder, and a check valve disposed adjacent said cylinder rod channel with a fluid entry channel of said check valve assembly communicating with the top of said cylindrical pipe section; and a packer assembly mounted to the exterior of said cylindrical pipe section intermediate said top and bottom ends thereof, said packer assembly including a packer mounting collar fastened to the exterior surface of said cylindrical pipe section a moderate distance below the top end thereof and having means forming a fluid tight seal with said exterior pipe surface, and tapered external threads formed on the bottom end thereof; a check valve collar threaded onto said bottom end of said packer mounting collar and having a central channel of a diameter greater than the outer diameter of said pipe section to form a first annular fluid channel therebetween and having tapered internal threads formed on a bottom end thereof; a check valve mounted to said check valve collar in fluid communication with said first annular fluid channel and adapted to be coupled to a hydraulic fluid line supplying said hydraulic cylinder; a bladder support pipe threaded at the top end thereof into said check valve collar and having a central channel of a diameter greater than the outer diameter of said pipe section to form a second annular fluid channel communicating with said first annular fluid channel, a plurality of fluid ports being formed in an intermediate section of said bladder support pipe to communicate fluid between said second annular fluid channel and the exterior of said bladder support pipe, and tapered external threads formed on a bottom end of said bladder support pipe; a pressure release valve assembly threaded onto the bottom end of said bladder support pipe and including a pressure release valve communicating with said second annular fluid channel and sealing means forming a closed fluid seal with the external surface of said cylindrical pipe section at the end of said second annular fluid channel; an inflatable cylindrical bladder having an internal diameter substantially corresponding to the outer diameter of said bladder support pipe and being carried on said bladder support pipe with a central region thereof covering said fluid ports; and mounting means carried on said bladder support pipe for fastening end sections of said bladder to said bladder support pipe, leaving a central section thereof overlying said fluid ports free to expand against the wall of the well casing.

7. An oil well pumping unit as claimed in claim 6, wherein said cylinder mounting collar assembly includes a valve bypass channel extending between said check valve assembly and said cylinder rod channel for cooperating with at least one flat edge surface formed at the bottom end of the hydraulic cylinder rod to communicate fluid between said check valve assembly and said cylindrical pipe section when said cylinder rod is at the end of its up stroke.

8. An oil well pumping unit as claimed in claim 6, wherein said pressure release valve assembly comprises a pressure valve collar threaded onto the bottom of said bladder support pipe and having a central channel with a diameter greater than the outer diameter of said pipe section to form a continuation of said second annular fluid channel, a valve channel formed between the top and bottom surfaces of said pressure valve collar, a fluid port formed between said valve channel and said second annular fluid channel, and a blowout pressure valve mounted in said valve channel and comprising a valve stem received within said valve channel and a sealing ring carried on each end of said valve stem to provide a fluid seal between said valve stem and said valve channel, said valve stem having a central section of reduced cross section forming a tension release pin having a preset pressure threshold at which said tension pin will separate.

9. An oil well pumping unit comprising an oil pump unit and a hydraulic cylinder coupled in driving relation to said pump unit and adapted to be mounted along with said pump unit within a bore hole; said cylinder having top and bottom fluid ports and a cylinder rod operatively driving said pump unit; hydraulic drive/control means coupled to one of said fluid ports to provide a hydraulic power stroke of said cylinder rod in one direction; and means coupling the other of said fluid ports of said cylinder to an energy storage system adapted to store a portion of the energy supplied to said cylinder during said hydraulic power stroke to provide energy for producing a return stroke of said cylinder rod; said oil pump unit comprising:

an elongated cylindrical pump barrel;

a first stationary valve mounted at a bottom end of said pump barrel for controlling the entry of bore hole fluid;

a second stationary valve mounted at a top end of said pump barrel for controlling the exit of bore hole fluid from said pump barrel into the well casing above said pumping unit;

packing means mounted in an intermediate position on said pump barrel for retaining said pump barrel in a position within the well casing and forming a seal between the inner wall of the well casing and said pump barrel to define high and low pressure regions of the well respectively above and below said packing means;

cylinder mounting means for mounting said hydraulic cylinder in a substantially sealed manner on top of said pump barrel with said cylinder rod coaxial with said pump barrel and sized to be received in an unsealed, loosefitting manner within said pump barrel on a downstroke of said cylinder rod to displace bore hole fluid within said pump barrel through said second valve;

said packing means includes a packer mounting collar mounted in a sealed relation to the exterior of said pump barrel a moderate distance below said top end thereof; a check valve assembly comprising a check valve collar mounted to said packer mounting collar and defining first annular fluid channel between an inner surface of said check valve collar and an outer surface of said pump barrel, a check valve mounted to said check valve collar with said check valve collar including an inflating fluid passage formed between said check valve and said first annular fluid channel; and an inflatable bladder assembly comprising a bladder support cylinder mounted to said check valve mounting collar and forming a second annular fluid channel between an interior surface of said bladder support cylinder and the outer surface of said pump barrel, an inflatable cylindrical bladder mounted on opposite ends thereof to the exterior of said bladder support cylinder, and a combined sealing and pressure release valve assembly mounted to the bottom of said bladder support cylinder and including a pressure release valve communicating with said second annular fluid channel and having a preset pressure release threshold; said bladder support having a plurality of apertures formed through the walls thereof to communicate inflating fluid to said bladder, said check valve being coupled to the power hydraulic fluid line to said hydraulic cylinder for initial inflation of said bladder to a pressure below the threshold of said pressure release valve to retain said pump unit in a position within the well casing and for subsequent inflation to a pressure above the threshold of said pressure release valve to blow said release valve and deflate said bladder to permit removal of the pumping unit from the well casing.

10. An oil well pump unit as claimed in claim 9, wherein said sealing and pressure release valve assembly comprises a pressure valve collar mounted on the bottom of said bladder support cylinder and defining an annular fluid channel between said pressure valve collar and the exterior of said pump barrel, a valve channel formed between top and bottom surfaces of said pressure valve collar and an aperture formed between said valve channel and said annular fluid channel; sealing means mounted on the bottom of said pressure valve collar for providing a fluid tight seal at the bottom end of said annular fluid channel; and a blowout pressure valve mounted in said valve channel and comprising a valve stem received within said valve channel and a sealing ring carried on each end of said valve stem to provide a fluid seal between said valve stem and said valve channel, said valve stem having a central section of reduced cross-section forming a tension release pin having a preset pressure threshold at which said tension pin will separate and the valve stem will be blown out of said valve channel.

11. An oil well pump unit as claimed in claim 9, wherein said cylinder mounting means and said second stationary valve form a combination valve and cylinder mounting assembly comprising a cylinder mounting collar mounted to the top of said pump barrel and having a passageway extending therethrough receiving said cylinder rod in a sliding seal arrangement, a check valve assembly provided in said cylinder mounting collar adjacent said cylinder rod passageway, and a lower fluid passageway extending between said check valve and a region below said cylinder rod passageway, and an upper fluid passageway extending between said check valve and an external surface of said mounting collar.

12. An oil well pump unit as claimed in claim 11, wherein said combined valve and cylinder mount assembly further includes a valve bypass channel extending between said upper fluid passageway and said cylinder rod passageway and said cylinder rod has at least one flat edge surface formed at the bottom end thereof adapted to communicate with said valve bypass channel when said cylinder rod is at the end of its upstroke.

13. The oil well pumping unit of claim 1, wherein said energy storage system comprises a pumping tee mounted at the top of said casing and having an outlet pipe for well fluid, and a pressure relief valve mounted to said outlet pipe to maintain a prearranged minimum pressure at the top of said casing whereby a portion of the energy from said hydraulic power stroke of said cylinder rod is stored in said high pressure region of said well casing.

14. An oil well pump unit as claimed in claim 13, wherein said hydraulic drive/control means is coupled to said bottom fluid port and said coupling means coupled to said top fluid port comprises a hydraulic fluid storage tube coupled on one end to said top fluid port and open at the other end to the well fluid column, said storage tube having an internal volume at least as great as the internal fluid volume of said hydraulic cylinder, a volume of hydraulic fluid being contained within said storage tube, and at least one traveling piston being carried within said storage tube to provide a travelling seal at the fluid interface between said hydraulic fluid and said well fluid.

* * * * *